United States Patent [19]

Rogers, Jr.

[11] 4,399,597

[45] Aug. 23, 1983

[54] METHOD AND APPARATUS FOR PRODUCTION OF TEXTURED YARN

[75] Inventor: Horace B. Rogers, Jr., Candler, N.C.

[73] Assignee: Akzona, Incorporated, Asheville, N.C.

[21] Appl. No.: 208,249

[22] Filed: Nov. 19, 1980

[51] Int. Cl.[3] ..... D02G 1/12; D02G 1/16

[52] U.S. Cl. ..... 28/250; 28/255; 28/264

[58] Field of Search ..... 28/248, 250, 255, 264

[56] References Cited

U.S. PATENT DOCUMENTS 3,777,338 12/1973 Vermeer et al. ..... 28/250
3,879,821 4/1975 Stanley ..... 28/255
4,095,317 6/1978 Eskridge et al. ..... 28/255 X
4,162,564 7/1979 Stanley ..... 28/250 X

FOREIGN PATENT DOCUMENTS 1161674 8/1969 United Kingdom ..... 28/250

*Primary Examiner*—Robert Mackey
*Attorney, Agent, or Firm*—Antonelli, Terry & Wands

[57] ABSTRACT

A method and apparatus for producing texturized multifilament yarn or the like which includes a control arrangement for controlling the length of a yarn plug in a bulking chamber and accumulating tube so that the processed yarn can be removed at a constant speed by a yarn take-up unit.

9 Claims, 3 Drawing Figures

METHOD AND APPARATUS FOR PRODUCTION OF TEXTURED YARN

The present invention relates to a method and apparatus for producing yarn and, more particularly, to a method and apparatus for producing texturized yarn or the like of multi-filament groups of synthetic materials wherein a feeder yarn is directed into a bulking chamber in which the yarn filaments are folded inwardly against themselves to form a compacted yarn mass or yarn plug with means being provided to control the length of the plug or mass so as to permit a constant take-up winding speed of the processed yarn.

A process and apparatus for texturizing or bulking a multi-filament synthetic polymeric yarn is disclosed, for example, in U.S. Pat. No. 3,983,610 and U.S. Pat. No. 4,095,317, wherein yarn is aspirated into a bulking or aspirator jet by a venturi effect of a heated gas, such as superheated steam or compressed air with the yarn carried in the gas stream entering a preheat tube where the yarn temperature is raised by the heated gas to plasticize the yarn prior to crimping and/or folding in the bulking chamber. In the preheat tube, the yarn is heated to temperatures between the second order transition point and the melting point of the yarn with the temperature of the yarn being maintained below the sticking point to avoid the formation of separate coherent filament groups within the yarn. The yarn and gas stream exit from the preheat tube into a diffuser zone having a diverging conical wall surface, in which zone the gas is expanded very rapidly to create great turbulence, thereby causing the yarn filaments to splay open, to flutter violently, and to more toward a conical wall surface with a folding-over of the yarn filaments occurring as the filaments impinge against each other and a smooth side wall surface of a plug-forming zone of a bulking chamber immediately adjacent to and downstream from the diffuser zone. The yarn accumulates at the front end of the bulking chamber to form a compacted mass in the form of an elongated, cylindrical plug which seals off the downstream end of the bulking chamber with further accumulation of the yarn and a force of the entering gas causing the accumulated yarn plug to be pushed forward into a slotted wall portion of the bulking chamber while the yarn newly entering the chamber impinges at random on the upstream end of the dynamically forming plug in the plug-forming zone.

In addition to using a fluid stream of hot air or steam for crimping of the yarn filaments, various other devices such as angled baffles, bulking tubes with reverse exhaust bulking chambers with lateral exhaust ports, rotating screen drums and the like have been employed; however, the use of such devices often imposes limitations on yarn speed, yarn uniformity or process flexibility in the known processes.

In order to overcome a number of drawbacks which accompany pneumatic bulking techniques, a process and apparatus is disclosed, for example, in U.S. Pat. No. 2,982,082, wherein continuous filament yarn is fed into a jet by a pair of rollers, which jet has an inlet tube extending through a chamber and is provided with a jet tip which faces and enters the mouth of a venturi passage. The other surface of the jet and mouth of the venturi cooperate to form an annular passage for a fluid stream under pressure to be blown into the chamber and out of the venturi. The yarn is drawn out by the jet by an additional pair of rollers at such a rate that the yarn is overfed to the jet so that the individual filaments of yarn are formed into loops and curls by the turbulence of the air stream beyond the annular passage within the jet.

Moreover, in U.S. Pat. No. 3,373,470, a process for a stuffer-type crimping of thermoplastic filaments is disclosed wherein the filaments are introduced into one end of an elongated confined space by a stream of fluid such as steam under pressure at a temperature sufficient to set the filaments. The filaments are tightly packed within the confined space by a controllable releasing part of the fluid from the confined space laterally of the confined space at a position spaced from the other end and the other packed filaments are then forced through the space to the other end under pressure by the remaining portion of the fluid which exhausts with the yarn. The confined space required for this process is defined by a metal spring having gaps between the convolutions thereof. The yarn is propelled by the action of the fluid from a nozzle through a tubular passage and then into the interior of the spring with the spring being curved to a desired extent to obtain optimum packing of the yarn therein.

A further process for providing a crimp to synthetic yarns is disclosed in U.S. Pat. No. 3,380,242, wherein the yarn is subjected to the action of a turbulent stream by passing it through a jet to which hot gas is supplied. The yarn and hot gas leave the jet and enter a venturi tube wherein the individual filaments of the yarn, while in a plastic state and under a substantially zero tension, are separated from each other and crimped individually while whipping about in the turbulent plasticizing stream. The crimp produced by this process has a random, three-dimensional, curvilinear, extensible configuration.

A further bulking and crimping arrangement is disclosed in U.S. Pat. No. 3,961,401 wherein a yarn feed means is arranged so as to form a yarn package or yarn plug with means for taking off yarn from an end of the yarn package or plug and heat-exchanging means arranged so as to be in heat-exchanging relation with the yarn on its way to the yarn package or plug. Sensing means are provided for sensing the take-off end of the package or plug and provide a control signal to the heat-exchanger means to control the operation thereof. The yarn feed means may be constructed as a fluid jet or feed nip rollers with a stuffer tube or movable surface being provided for receiving the yarn package or plug.

Furthermore, in U.S. Pat. No. 3,961,402, a yarn process is disclosed wherein heated yarn is driven forward to form an elongated package or plug of compressed yarn to which yarn is continually added at one end and withdrawn from the other end with the magnitude of deviation of the position of the take-off end from a predetermined position being measured and used as a control parameter to control the temperature of the heated yarn.

Additionally, if desired, a specific annealing and air tangling arrangement may be employed such as, for example, disclosed in U.S. Pat. No. 3,461,521 wherein the yarn is passed through a tangle jet for additional bulk control to establish desired yarn properties and then through a steam annealing jet before winding into a take-up package.

In the production of texturized yarn, it has been determined that the position of the compacted yarn mass or yarn plug is dependent upon the temperature and/or the pressure of the entering heated gas, as well as the temperature of the preheated feeder yarn and yarn sensing means can be disposed in the bulking chamber to determine the position of the initially formed yarn plug so that when the front of the plug is displaced from the smooth wall portion of the bulking chamber onto a slotted portion, the temperature and/or pressure of the gas is decreased sufficiently to cause the yarn plug to return to its proper position on the front smooth wall portion. Moreover, the displacement of the plug into a diffuser can be corrected by increasing the temperature and/or pressure.

Generally, the yarn plug moves at a rate on the order of 1/200th of the yarn input rate in the conduit means guiding the yarn with the yarn plug being directed into the plug guide wherein an accumulator device or yarn sensing means such as, for example, feeler elements contact the yarn. When the plug moves beyond a predetermined set point, the yarn feeler elements close a switch and thereby cause the apparatus to shut down. If the yarn recedes toward the inlet of the plug guide and accumulator device, another feeler element and associated switch are actuated to cause the shut down. Additional sensing means may be disposed between these positions in order to regulate the speed of the take-up device as, for example, in the control arrangement of U.S. Pat. No. 4,014,085.

While the above-noted prior art attempts have met with considerable success, there are still a number of drawbacks with respect to the overall efficiency of the process and apparatus for manufacturing yarns in addition to variations in the plug length, density of the plugs, instability in the bulk and crimp of the plugs, and variations in the yarn delivery and wind-up speed. Specifically, in practice, due to variations in the steam temperature and pressure, the yarn plug varies which, in turn, requires a variable take-up or wind-up speed of the processed yarn.

The aim underlying the present invention essentially resides in providing an improved method and apparatus for the production of multi-filament synthetic polymeric yarns. For this purpose, means are provided for controlling the yarn plug formation at the bulking chamber thereby improving the overall processing of the yarn.

As known, several factors such as yarn denier, steam jet orifice size, steam temperature, steam pressure and various adjustments of the steam jet are determinitive of the position at which a yarn plug or package first starts building or forming, in addition to being determinitive of the speed of the plug through the bulking chamber. During an operation of a steam jet bulking or crimping process, the steam pressure escapes from the jet housing through slit areas provided in a bulking chamber.

According to one advantageous feature of the present invention, a sleeve means is mounted so as to be selectively displaceable at least along a portion of the bulking chamber in a direction away from the jet housing toward the accumulating tube. Moreover, the sleeve means has a predetermined axial length and is arranged at the back or steam jet end of the bulking chamber so as to cover a portion of the slots in the bulking chamber. By virtue of this arrangement, the steam pressure is effective or acts upon the yarn plug or package for a greater length of time so that the yarn plug moves at a faster rate through the bulking chamber and accumulating tube than in conventional arrangements.

Preferably, according to the present invention, the sleeve means has an axial length of at least one inch so that, when placed against the jet housing, at least the first inch of the bulking chamber is covered and the yarn plug begins to form at the end of the sleeve area. When the sleeve is moved toward the front of the bulking chamber, the steam acting upon the plug being formed escapes at the end of the jet housing so as to cause the plug movement to slow down due to the plug then building up back toward the jet housing. This movement of the sleeve will contain the plug within the yarn accumulating tube and prevent overfeeding out of the accumulating tube and underfeeding back into the jet housing.

According to a further advantageous feature of the present invention, to control the position of the sleeve on the bulking chamber, a free moving plunger is provided and arranged inside of the accumulating tube at a desired position for the yarn to exit from the accumulating tube and proceed to a wind-up or take-up head or unit. An arm or linkage of metal or the like is interposed between the plunger and the sleeve means on the bulking chamber with a biasing means being arranged between the sleeve means and the jet housing for normally biasing the sleeve means in a direction toward the jet housing. By virtue of this arrangement, after the yarn plug begins to form and moves the plunger, the yarn will pack up against the plunger until enough force is created by virtue of the steam acting on the formed yarn plug to overcome the tension of the biasing means holding the sleeve against the jet housing. Upon the occurrence of such force, the sleeve means will move toward the plunger, thereby opening the slot area of the bulking chamber so as to permit the steam pressure to escape from the ends of the slots adjacent the jet housing. The escaping steam in turn will cause the yarn plug to slow down and start building back toward the jet housing. During this period of slow down, the yarn take-up head is operable to remove the excess yarn in the accumulating tube. After the yarn is removed from the plunger, the biasing means will urge the sleeve means back in a direction toward the jet housing, in which position the sleeve means will remain until the yarn plug reaches the plunger and forces an opening of the sleeve.

In accordance with yet another feature of the present invention, the biasing means may be constructed as a spring which maintains only enough tension to move the sleeve, arm and plunger back to the jet housing stop when the force of the plug is no longer effective on the plunger.

According to yet another feature of the present invention, a steam pressure control valve is arranged upstream of the steam jet disposed in the jet housing with the control valve being operatively connected with a solenoid actuator and a control switch disposed in the accumulating tube at a predetermined position thereof corresponding to a desired length of yarn plug. Upon the yarn plug activating the control switch, the solenoid actuator releases the steam pressure control valve so as to reduce the pressure effective on the yarn plug, thereby causing the plug movement to slow down and start building back toward the jet housing. During this time, the yarn take-up head removes the excess yarn in the accumulating tube. After the excess yarn is removed, the contact switch provides a signal to the solenoid actuator so as to control the position of the steam pressure control valve, thereby increasing the pressure effective upon the yarn plug in the bulking chamber and accumulating tube.

In accordance with a still further feature of the present invention, a steam pressure escape hole is provided in the jet housing with a steam release cap being disposed over the escape hole, which release cap is attached to a solenoid actuator which, in turn, is connected to a contact switch disposed at a position in the accumulating tube corresponding to the desired length of the yarn plug. Upon the yarn plug activating the switch, the solenoid actuator controls the position of the release cap to open or close the same. In such construction, a certain amount of pressure would be escaping at all times through the cap in order to obtain a higher steam pressure when the cap is completely closed.

Accordingly, it is an object of the present invention to provide a method and apparatus for producing textured yarn which avoids by simple means the drawbacks and shortcomings encountered in the prior art.

A further object of the present invention is to provide a method and apparatus for producing textured yarn which operates in a highly efficient manner during all operating conditions.

A still further object of the present invention resides in providing an apparatus for producing textured yarn which increases the bulk and crimp stability.

Yet another object of the present invention resides in providing an apparatus for producing textured yarn wherein the processed yarn may be wound with a constant take-up speed by controlling and varying the plug length formed in a bulking chamber of the apparatus.

These and other objects, features and advantages of the present invention will become more apparent from the following description when taken in connection with the accompany drawings which show, for the purposes of illustration only, several embodiments in accordance with the present invention, and wherein.

Figure 1:
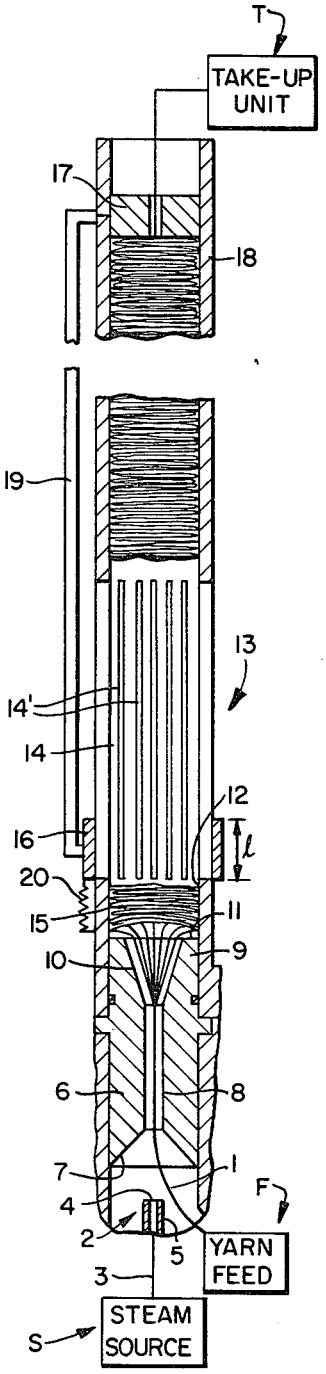
FIG. 1 is a partially schematic cross-sectional view of a first embodiment of an apparatus for texturizing a yarn in accordance with the present invention.

Referring now to the drawings wherein like reference characters are used throughout the various views to designate like parts and, more particularly to FIG. 1, according to this figure, feeder yarn 1 is drawn from a yarn feed apparatus generally designated by the reference character F into an aspirator jet unit generally designated by the reference numeral 2 through a yarn inlet tube (not shown). A gas such as, for example, superheated steam is supplied to the jet unit 2, arranged in a jet housing, from a steam source generally designated by the reference character S through a conduit 3 to a narrow passage 4 of a jet nozzle 5. A temperature sensing zone (not shown) is provided upstream of the jet nozzle 5 in a manner more fully disclosed in U.S. Pat. No. 3,983,610, the disclosure of which is incorporated herein by reference to the extent necessary in understanding the present invention.

Generally, a preheater arrangement (not shown) such as a plate heater, heated godet, or the like is provided for heating the yarn 1 to a temperature of 150° C.–200° C., prior to the yarn 1 entering the yarn inlet tube.

The heated yarn 1 and steam from the jet nozzle 5 enter a preheat tube 6 which is provided with a conically-shaped entrance 7, passage 8 and a conically-shaped discharge or diffuser 9.

In the diffuser 9, the steam rapidly expands and causes the yarn to splay outwardly toward the surface of the conical wall 10 of the diffuser 9. A flat shoulder 11 at the end of the diffuser 9 allows the yarn filaments to go onto a smooth wall portion 12 which defines the front end of a bulking chamber generally designated by the reference numeral 13. The yarn filaments fold inwardly against themselves so as to form a compacted yarn mass which accumulates and forms an elongated plug that is pushed into an air permeable or slotted wall portion 14 of the bulking chamber 13 by the back pressure developed in the smooth side wall portion due to resistance of the steam flowing through the plug. The bulking chamber 13 is formed by a tubular member with the slotted wall portion 14 being provided with a plurality of slots 14' arranged uniformly about the periphery of the tubular member.

In the smooth side wall portion, all of the steam passes axially through the formed plug 15 before discharging laterally through the slots 14' and exits through an exhaust chamber (not shown) surrounding the slotted wall portion 14 of the bulking chamber 13.

A metal sleeve 16 is arranged at the bulking chamber so as to surround and cover a portion of the slotted area thereof near the end of the preheater tube 6. The metal sleeve 16 has a predetermined length l which is preferably at least equal to one inch. A free moving plunger 17 is arranged in an accumulator tube 18 at a distance corresponding to a desired length of the yarn plug 15. A take-up unit generally designated by the reference character T, of conventional construction, withdraws the yarn plug 15 from the accumulator tube 18 at a constant take-up speed.

A linkage 19 is provided between plunger 17 and the metal sleeve 16 with a spring 20 being arranged between a portion of the linkage 19 and a portion of the bulking chamber 13. The spring 20 normally biases the sleeve 16 in a direction toward the preheater tube 6 to cover at least the first inch of the slots 14'.

In operation, after a plug 15 begins to form in the smooth wall portion 12 of the bulking chamber 13, the steam pressure acts on the yarn plug 15 which continues to build until the yarn plug 15 is displaced against the plunger 17 with a sufficient force so as to overcome the spring tension of the spring 20 holding the sleeve 16 at the lower end of the bulking chamber 13 blocking the length of the slots 14'. Upon the occurrence of such a force against the plunger 17, the sleeve 16, covering the slots 14', is moved against the bias of the spring 20 so as to provide an opening for the steam pressure to escape near the lower end of the bulking chamber 13. The escaping steam causes the yarn plug 15 to slow down and begin building back toward the end of the preheater tube 6.

During this time, the yarn take-up unit T continuously removes the excess yarn in the accumulating tube 18 at a constant rate. After the yarn is removed from the accumulator tube 18 and plunger 17, the spring 20 urges the sleeve 16 into the position illustrated in FIG. 1 with the sleeve remaining in such position until a yarn plug 15 once again reaches the plunger 17 and forces the sleeve 16 open again.

Figure 2:
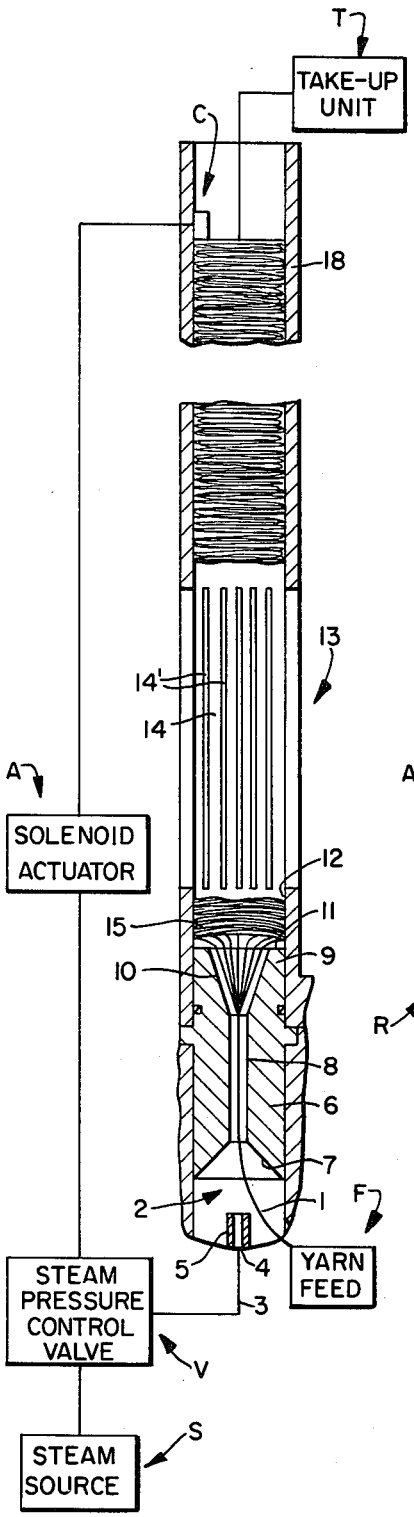
FIG. 2 is a schematic cross-sectional view of a further embodiment of an apparatus for texturizing yarn in accordance with the present invention.

As shown in FIG. 2, a steam pressure control valve generally designated by the reference character V is interposed between a steam source S and the jet nozzle 5 with a solenoid actuator generally designated by the reference character A, of conventional construction, being provided for selectively actuating the steam pressure control valve V in response to a plug 15 being sensed by a contact switch generally designated by the reference character C arranged in the accumulator tube 18.

As with the construction of FIG. 1, a yarn plug 15 is built in the smooth wall portion 12 of the bulking chamber 13 and the plug 15 continues building until a desired length is obtained, which length is reflected by the yarn plug actuating the contact switch C. The actuation of the contact switch results in an increase or reduction of pressure as necessary to contain the plug 15 inside the accumulating tube.

Figure 3:
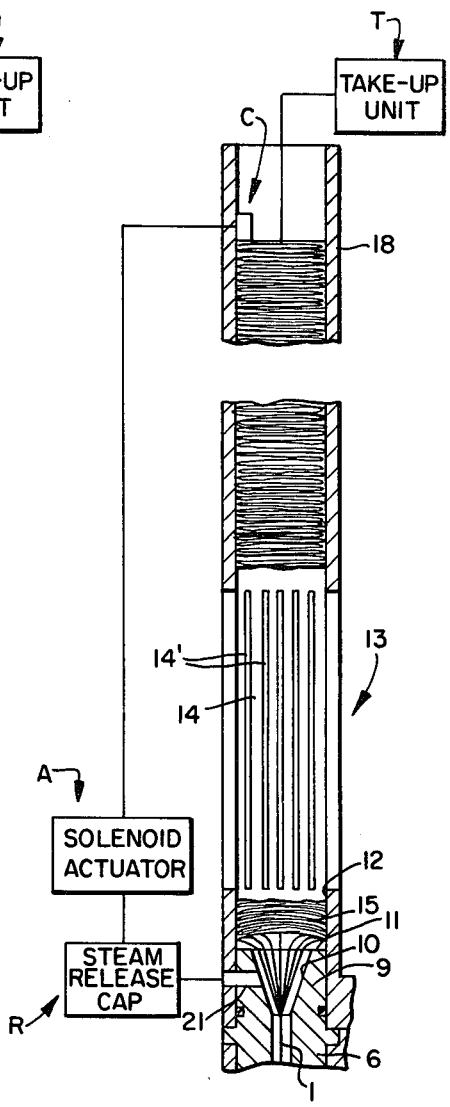
FIG. 3 is a partially schematic cross-sectional view of another embodiment of an apparatus for texturizing yarn in accordance with the present invention.

As shown in FIG. 3, a steam pressure escape hole 21 is provided in the preheater tube 6 with a steam release cap generally designated by the reference character R, of conventional construction, being arranged at the steam pressure escape hole 21 so as to open and close the same. A solenoid actuator A is provided for controlling the positioning of the steam release cap R with a contact switch C being disposed in the accumulator tube 18 at a position corresponding to a desired length of the yarn plug. Contact switch C, solenoid actuator A and steam release cap R open and close the escape hole 21 as necessary to contain the yarn inside the accumulating tube 18. By virtue of the presence of the steam pressure escape hole 21, it is necessary to provide a certain amount of pressure escaping at all times through the steam release cap R in order to obtain a higher steam pressure when the cap R is completely closed off.

While I have shown and described several embodiments in accordance with the present invention, it is understood that the same is not limited thereto, but is susceptible of numerous changes and modifications as known to one skilled in the art, and I therefore do not wish to be limited to the details shown and described herein, but intend to cover all such changes and modifications as are encompassed by the scope of the appended claims.

What I claim is:

1. An apparatus for texturizing yarn, the apparatus comprising:

a bulking chamber having a smooth wall portion adjacent a yarn inlet end thereof and a gas permeable wall portion adjacent said smooth wall portion, said smooth wall portion having a length sufficient to ensure a formation of a compacted yarn mass therein, means for producing and supplying a heated gas stream to the bulking chamber, means for introducing the yarn into the heated gas stream, means arranged at the yarn inlet end of said bulking chamber for causing yarn filaments of the yarn in the heated gas stream to splay outwardly and cause contact of the yarn filaments with said smooth wall portion thereby forming the compacted yarn mass, and means for controlling a length of the compacted yarn mass so as to permit a constant speed take-up of the processed yarn including sleeve means displaceably mounted at the bulking chamber for covering a predetermined axial length of the gas permeable wall portion of the bulking chamber, and means for displacing the sleeve means in an axial direction of the bulking chamber upon the compacted yarn mass forming a yarn plug of a predetermined length.

2. An apparatus for texturizing yarn, the apparatus comprising:

a bulking chamber having a smooth wall portion adjacent a yarn inlet end thereof and a gas permeable wall portion adjacent said smooth wall portion, said smooth wall portion having a length sufficient to ensure a formation of a compacted yarn mass therein, said bulking chamber being formed by a tubular member and the gas permeable wall portion having a plurality of slots spaced around the periphery of the tubular member, said slots extending in parallel to each other and to a longitudinal axis of said tubular member, means for producing and supplying a heated gas stream to the bulking chamber, means for introducing the yarn into the heated gas stream, means arranged at the yarn inlet end of said bulking chamber for causing yarn filaments of the yarn in the heated gas stream to splay outwardly and cause contact of the yarn filaments with said smooth wall portion thereby forming the compacted yarn mass, and means for controlling a length of the compacted yarn mass so as to permit a constant speed take-up of the procesed yarn including a sleeve means displaceably mounted at said bulking chamber, said sleeve means having a predetermined axial length so as to cover portions of said slots, means operatively connected with said sleeve means for normally biasing said sleeve means in a direction toward said smooth wall portion of said bulking chamber, and means for displacing said sleeve means against a bias of said biasing means upon the compacted yarn mass forming a yarn plug of a predetermined length.

3. An apparatus according to claim 2, wherein said predetermined axial length of said sleeve means is equal to at least one inch.

4. An apparatus according to claim 3, wherein said means for producing and supplying a heated gas stream includes a heated gas supply means, jet means operatively connected with said supply means for producing the gas stream, said means for introducing includes a yarn inlet means, preheat tube means defining a narrow passage for receiving the yarn carried by the gas stream and for allowing the yarn to be preheated by the gas, and a diffuser having a diverging conical surface at the end of said preheat tube, and wherein said means for causing yarn filaments to splay outwardly includes a flat shoulder provided on said diffuser extending perpendicular to said smooth wall portion of said bulking chamber.

5. An apparatus according to claim 2, wherein said means for producing and supplying a heated gas stream includes a heated gas supply means, jet means operatively connected with said supply means for producing a gas stream, said means for introducing includes a yarn inlet means, preheat tube means defining a narrow passage for receiving the yarn carried by the gas stream and for allowing the yarn to be preheated by the gas, and a diffuser having a diverging conical surface at an end of said preheat tube, and wherein said means for causing yarn filaments to splay outwardly includes a flat shoulder provided on said diffuser extending perpendicular to said smooth wall portion of said bulking chamber.

6. An apparatus according to claim 2, wherein said bulking chamber includes an accumulator tube disposed at an end of the bulking chamber opposite the yarn inlet end, said means for controlling includes a plunger arranged in the accumulator tube, and wherein said displacing means includes a control linkage having a first end connected to the sleeve means and a second end connected to the plunger.

7. An apparatus according to claim 6, wherein said predetermined axial length of said sleeve means is equal to at least one inch.

8. An apparatus according to claim 6, wherein said means for producing and supplying a heated gas stream includes a heated gas supply means, jet means operatively connected with said supply means for producing a gas stream, said means for introducing includes a yarn inlet means, preheat tube means defining a narrow passage for receiving the yarn carried by the gas stream and for allowing the yarn to be preheated by the gas, and a diffuser having a diverging conical surface at an end of said preheat tube, and wherein said means for causing yarn filaments to splay outwardly includes a flat shoulder provided on said diffuser extending perpendicular to said smooth wall portion of said bulking chamber.

9. A method for texturizing yarn, the method comprising the steps of: feeding a yarn in a gas stream to a bulking chamber having a smooth wall portion and a gas permeable wall portion, splaying yarn filaments outwardly in the bulking chamber to contact the smooth wall portion so as to form a compacted yarn mass in the smooth wall portion of the bulking chamber, and controlling a length of the compacted yarn mass so as to permit a constant speed take-up of the processed yarn by covering a predetermined axial length of the gas permeable portion of the bulking chamber with a cover means until the compacted yarn is displaced a predetermined distance through the bulking chamber, and automatically displacing the cover means in an axial direction of the bulking chamber to uncover the predetermined axial length of the gas permeable portion of the bulking chamber in response to the compacted yarn means being displaced through said predetermined distance.

* * * * *